US007871221B2

(12) United States Patent
Menzel et al.

(10) Patent No.: US 7,871,221 B2
(45) Date of Patent: Jan. 18, 2011

(54) DELINEATING POLE HAVING AN ANCHORING BASE AND SPRING CARTRIDGE FOR SNOW BASED APPLICATIONS

(75) Inventors: Christoph P. Menzel, New London, NH (US); Steven Barss, Wilmot, NH (US)

(73) Assignee: MBW Technologies, LLC, New London, NH (US)

( * ) Notice: Subject to any disclaimer, the term of this patent is extended or adjusted under 35 U.S.C. 154(b) by 0 days.

(21) Appl. No.: 12/842,289

(22) Filed: Jul. 23, 2010

(65) Prior Publication Data

US 2010/0290834 A1 Nov. 18, 2010

Related U.S. Application Data

(62) Division of application No. 11/782,143, filed on Jul. 24, 2007, now Pat. No. 7,794,175.

(51) Int. Cl.
*E01F 9/011* (2006.01)

(52) U.S. Cl. ..... 404/9; 404/10

(58) Field of Classification Search ..... 404/6, 404/9–11

See application file for complete search history.

(56) References Cited

U.S. PATENT DOCUMENTS

| | | | | |
|---|---|---|---|---|
| 1,343,384 | A | 6/1920 | Blackburn | |
| 1,597,573 | A * | 8/1926 | Blue | 40/124.5 |
| 3,091,997 | A | 6/1963 | Byrd | |
| 3,371,647 | A | 3/1968 | Shopbell | |
| 4,270,873 | A | 6/1981 | Laehy et al. | |
| 4,491,438 | A | 1/1985 | Berutti | |
| 4,588,324 | A | 5/1986 | Goellner | |
| 4,599,012 | A | 7/1986 | Kugler et al. | |
| 4,702,639 | A | 10/1987 | Hinterholzer | |
| 4,738,060 | A * | 4/1988 | Marthaler et al. | 52/103 |
| 4,871,279 | A | 10/1989 | Hinterholzer | |
| 5,024,551 | A | 6/1991 | Hinterholzer | |
| 5,054,955 | A | 10/1991 | Habernig | |
| 5,257,874 | A | 11/1993 | Kato et al. | |
| 5,507,589 | A | 4/1996 | Jacobs | |
| 5,579,720 | A * | 12/1996 | Udelle et al. | 119/621 |
| 6,461,084 | B1 * | 10/2002 | Stuart | 405/244 |
| 6,969,212 | B1 | 11/2005 | Richens et al. | |

(Continued)

FOREIGN PATENT DOCUMENTS

| | | |
|---|---|---|
| DE | 8518438 | 6/1985 |

(Continued)

*Primary Examiner*—Raymond W Addie
(74) *Attorney, Agent, or Firm*—Robert Curcio; DeLio & Peterson, LLC

(57) ABSTRACT

An anchoring base for a delineating pole using the reconfiguration of protruding resilient mechanical members to facilitate insertion and resist the subsequent extraction force on the pole. The mechanical members extend outwards relative to the insertion rod longitudinal axis, and bend or configure upon insertion of the anchoring base, into a first position that facilitates insertion while impeding and resisting axial extraction forces, and upon subsequent rotation of the anchoring base, the mechanical members bend or reconfigure into a second position such that the extraction resistance force is significantly reduced. The anchoring base design may be used in conjunction with a spring cartridge having a plurality of interlocking members forming a rigid mechanical structure during rotation.

13 Claims, 9 Drawing Sheets

U.S. PATENT DOCUMENTS 7,025,016 B1 4/2006 Landes

FOREIGN PATENT DOCUMENTS

JP 2003193433 A1 9/2003
WO WO 83/03361 A1 10/1983
WO WO 89/07477 A1 8/1989
WO WO 93/22507 A1 11/1993
WO WO 98/51380 A1 11/1998
WO WO 99/03543 A1 1/1999
WO WO 99/41130 A1 8/1999

* cited by examiner

DELINEATING POLE HAVING AN ANCHORING BASE AND SPRING CARTRIDGE FOR SNOW BASED APPLICATIONS

CROSS REFERENCE TO RELATED APPLICATION

This application is a Divisional Application of U.S. patent application Ser. No. 11/782,143 which was filed on Jul. 24, 2007, and claims priority thereto.

BACKGROUND OF THE INVENTION

1. Field of the Invention

The present invention relates to delineator poles that may be used for delineating boundaries in different applications. Specifically, the present invention relates to an anchoring base and spring cartridge for self-aligning, pivotable delineator poles used in snow sports, and more specifically to self-aligning, pivotable delineator poles for ski racing applications, and for temporary or movable markings, netting, or barriers for trail safety applications.

2. Description of Related Art

Many different types of pivotable delineator poles for snow-based applications are used for such things as slalom gates or hazard markers, to name a few. Delineating poles are often damaged or cause damage when a moving object comes into contact with the pole. Ski racing, for example, involves full contact between skiers traveling at high velocities and slalom poles resulting in damage to the poles and, in many instances, harm to the skiers.

Poles used in ski racing to delineate the racecourse are called alternatively slalom gates or simply gates. As depicted in FIG. 1, a typical slalom gate or pole 10 is generally constructed of three major components: 1) a shaft 12, which is typically hollow and made of plastic; 2) a spring cartridge or mechanism 14 used for pole bending; and 3) ground engagement means or anchoring base 16. Generally, shaft 12 is a simple, hollow, rigid plastic tube that provides the function of delineating a physical location in a highly visible manner. Spring cartridge or mechanism 14 slides into the bottom of shaft 12 and is fixably attached to shaft 12. Similarly, on its opposite end, spring cartridge 14 slides into anchoring base 16 and is fixably attached thereto as well.

Spring cartridge 14 is typically constructed as depicted in FIG. 2. A flexible polymer tendon 22 performs the bending function for the pole to respond to the impact force supplied by a skier. Springs 24 provide the restoring force to return or self-align the gate in the vertical position. Tendon 22 is protected by a series of superposed annular members such as external collars or rings 26. Rings 26 are typically circularly symmetric and donut-shaped, made from a hard nylon material or the like. Tendon 22 cooperates with springs 24 and rings 26 to promote the flexible bending and restoration of the pole segments relative to one another. Rings 26 also provide leverage for tendon 22 during flexing or bending, and are used as a "stop" to define the vertical rest position of the gate.

During bending, rings 26 assume angular positions along the curvature of the bent surface of slalom gate 10. Rings 26 provide for a flexible bend radius of flexure for slalom gate 10, thereby minimizing the danger of breakage of slalom gate 10 due to over bending and to reduce the chances of injury to the skier. Rings 26 also serve to keep out dirt and snow from normally entering the pole.

One such structure is identified in U.S. Pat. No. 4,588,324, issued to Goellner, entitled "SLALOM POLE." Goellner discloses a delineating pole which is supported by a lower part placed in the ground, and an upper part which is made to pivot against the lower part when subjected to an impact force. In the Goellner design, the upper, middle, and lower portions of the pole are held together in tension by a sprung axial cable. The upper and lower portions each include a respective spring. The tension spring cooperates with collars to provide for a flexible bending radius of flexure of the pole.

Another approach is taught in U.S. Pat. No. 4,270,873 issued to Laehy, et al., entitled "PIVOTABLE DELINEATOR POST." The Laehy pole includes upper and lower segments with a biasing spring completely housed within the lower pole segment. The upper and lower pole segments are joined by the spring and are held in axial alignment by the mating cooperation of a rounded edge lip portion adjacent the lower pole segment and a rounded groove flange adjacent the upper pole segment. Whenever the upper and lower pole segments are moved out of axial alignment, the force of the spring together with the rounded edge lip portion and the groove of the flange interact to guide the segments back into axial alignment.

The form of current slalom gates has so developed in order to provide certain desirable functions. First, the gate must define a particular point on the slope in a highly visible manner. Second, as the ski racer strikes the slalom gate, the pole must move quickly to the skier's impact force while remaining securely anchored in the snow. Third, the pole must, after responding to the skier's impact force, return to its original vertical position, thereby re-aligning itself. The three major components of the slalom gate discussed above work together to provide these functions.

Slalom poles are usually anchored in a layer of snow or ice on a ski slope, commonly referred to as a snow pack. In most cases the anchoring is made by drilling a hole in the packed snow or ice, whereupon the pole or an anchoring device connected to the pole is fixed in the snow pack. It is desirable for the slalom pole to be fixable in and removable from the snow pack in a quick and easy manner. At the same time, the slalom pole fixed in the snow pack must be held in a stable manner even when subjected to impacts and blows from the skier.

Referring to FIG. 1, the anchoring base 16 is typically a plastic shaft approximately thirteen (13) inches in length and having large, coarse threads 18 for forming a screw-shaped operating rod with a conical end. Anchoring base 16 is screwed into a pre-drilled hole in the snow. In order to secure anchoring base 16 in the snow, the slalom pole is fitted with external wrench engaging means to mate with a specialized wrench. The wrench engaging means is adapted to be engaged by a specialized wrench (not shown) in order to rotate slalom gate 10 about its longitudinal axis. This rotation permits coarse threads 18 to thread the snow pack, which seats slalom pole 10 in the snow. The purpose of coarse threads 18 on anchoring base 16 is simply to secure the slalom pole within the snow upon rotation. A user cannot simply push the slalom pole with threads on its anchoring base into the hole, or pull the slalom pole with threads on its anchoring base out of the hole, without performing a number of rotations. Furthermore, currently available slalom poles without threads do not provide for sufficiently secure anchors to allow them to remain in place when impacted by a skier.

As it is advantageous for a ski race to be held on packed snow, it is commonplace for the snow to be very hard, dense, and icy in the vicinity of the racecourse, and most likely where the gates must be installed. In fact, often various means are employed to facilitate installation of the gates, such as salting or injecting water to make the snow surface harder and more resistant to wear during the race.

The anchoring device takes a long time to screw it in position, as well as to unscrew it. As such, setting a course, even for simple training exercises, is timely and labor intensive. Generally, using prior art slalom poles, three people are required to set a racing course: one to drill a hole, a second to carry and supply the slalom poles, and a third to rotate the anchoring base. Furthermore, when screwing an anchoring base into a hard snow pack, a substantial amount of torque is required at the anchoring base since spring cartridges of the prior art cannot withstand the rotational extraction force. Thus, the insertion and operation of the specialized wrench requires an operator to stoop down or bend on the slope in an unnatural position for a lengthy insertion and extraction process, which can cause physical exertion.

SUMMARY OF THE INVENTION

Bearing in mind the problems and deficiencies of the prior art, it is therefore an object of the present invention to provide a slalom gate that reduces the time required to set-up and take-down in packed snow.

It is another object of the present invention to provide a slalom gate that can be secured in packed snow without extra or specialized tools.

A further object of the invention is to provide a slalom gate that can be secured in packed snow or ice without substantial physical exertion, and then be subsequently removed as needed, also without substantial physical exertion or specialized tools.

Still other objects and advantages of the invention will in part be obvious and will in part be apparent from the specification.

The above and other objects, which will be apparent to those skilled in the art, are achieved in the present invention which is directed to an anchoring base for a delineator pole for snow based applications comprising an insertion rod having a longitudinal axis, the insertion rod including a plurality of resilient mechanical members extending outwards relative to the insertion rod longitudinal axis, the plurality of resilient mechanical members bending or configuring upon insertion of the anchoring base, into a first position or configuration that facilitates insertion while impeding and resisting axial extraction forces, and upon subsequent rotation of the anchoring base, the plurality of mechanical members bending or reconfiguring into a second position or configuration reducing the anchoring base extraction resistance force. The anchoring base may include a flange and a connector portion having a first end attached to the insertion rod and a second end attached to the flange. The anchoring base may include a stabilizer for limiting lateral movement. The stabilizer may be connected or integral with the insertion rod. The anchoring base may also include having the plurality of resilient mechanical members comprise flexible metal, wire, plastic, or rubber segments. The insertion rod may comprise a wire brush structure.

The plurality of resilient mechanical members may be arranged in an upward direction at an angle less than ninety degrees from the longitudinal axis. The resilient mechanical members may also comprise flexible discs or vanes, or a plurality of bristles or bristle tufts. Spacers may be placed between the mechanical members.

In a second aspect, the present invention is directed to a delineator pole for snow-based applications comprising: an anchoring base including an insertion rod having a longitudinal axis, the insertion rod including a plurality of resilient mechanical members extending outwards relative to the insertion rod longitudinal axis, the plurality of resilient mechanical members bending or configuring upon insertion of the anchoring base, into a first position or configuration that facilitates insertion while impeding and resisting axial extraction forces, and upon subsequent rotation of the anchoring base, the plurality of mechanical members bending or reconfiguring into a second position or configuration such that the anchoring base extraction resistance force is reduced; and a spring cartridge comprising: a flexible tendon; at least one spring; and a plurality of rings or collars having interlocking members, such that each ring interlocks with an adjacent ring to form a rigid mechanical structure during rotation. The interlocking members may include alternate protrusions and indentations, such as teeth and notches, on top and bottom surfaces of the plurality of rings.

In a third aspect, the present invention is directed to a method of extracting a delineating pole comprising a shaft, a spring cartridge, and an anchoring base having a plurality of resilient mechanical members, the method comprising: reconfiguring the plurality of resilient mechanical members within a snow pack by rotating the anchoring base; and applying a vertical extracting force to the delineating pole.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-12 of the drawings in which like numerals refer to like features of the invention.

In a preferred embodiment, the present invention uses the reconfiguration of protruding mechanical members from an anchoring base of a slalom pole during the insertion process to facilitate insertion and resist the subsequent extraction of the pole. The protruding mechanical members are flexible upon insertion such that the insertion force is relatively small. Upon impact, the reconfigured mechanical members oppose any directional removal motion that would result in an inadvertent extraction. However, the preferred embodiment also provides a means for a second reconfiguration of the mechanical members, initiated by the user, which allows the slalom gate to be extracted with minimum effort.

Figure 1:
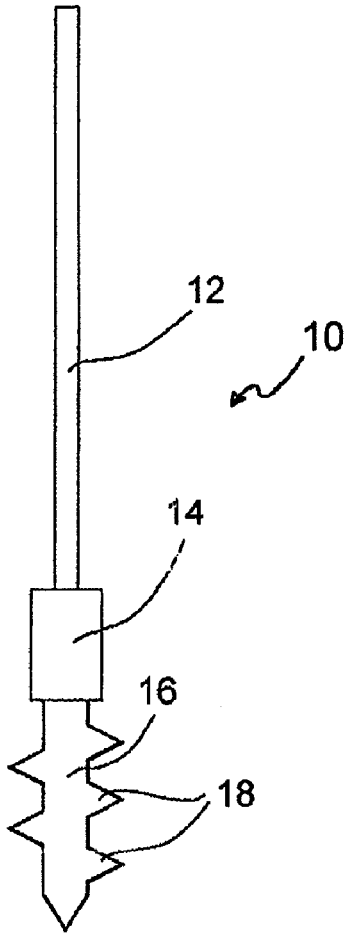
Fig. 1 (PRIOR ART)
FIG. 1 depicts a slalom gate or pole of the prior art.
Figure 2:
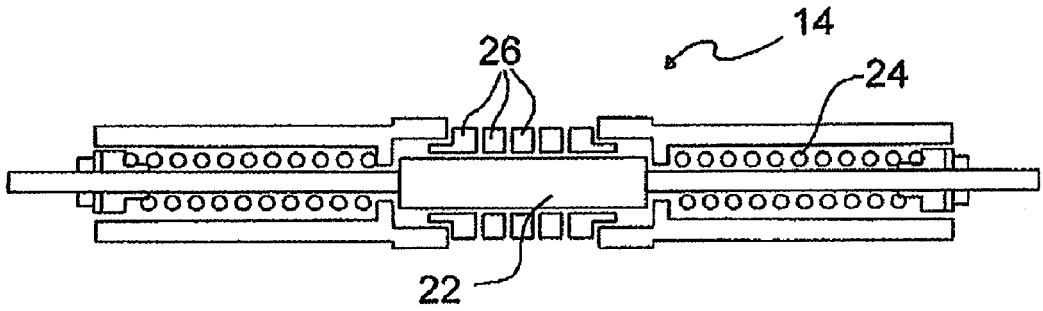
Fig. 2 (PRIOR ART)
FIG. 2 depicts a cross-sectional view of the spring mechanism of a slalom gate or pole of the prior art.
Figure 3:
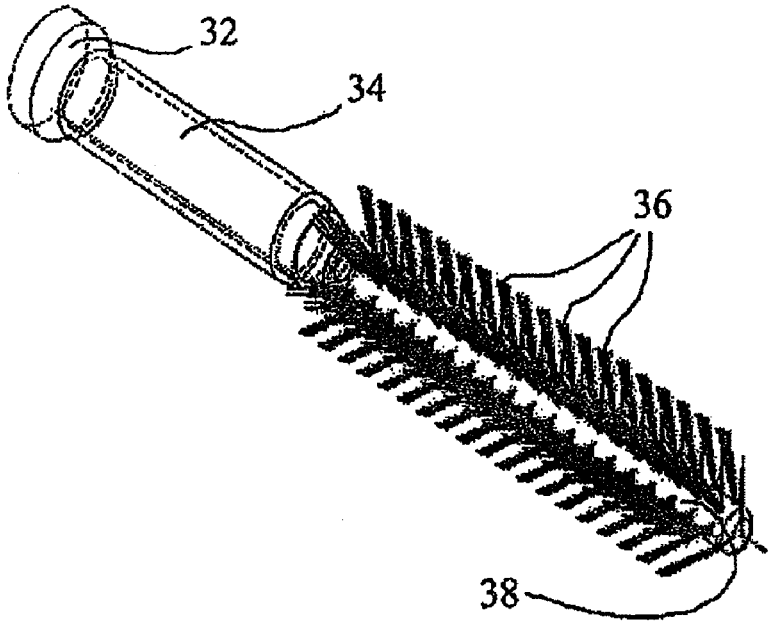
FIG. 3 depicts an anchoring base of the present invention having mechanical members.

FIG. 3 depicts an anchoring base 30 of the present invention. Anchoring base 30 comprises at one end an optional flange 32, a center connector portion 34, and an insertion rod 36 at the other end. Insertion rod 36 is populated with a plurality of mechanical members 38. Mechanical members 38 are resilient segments, strands, discs, vanes, fibers, hairs, or as shown in FIG. 3, bristles, that extend radially outward from insertion rod 36. Resilient mechanical members 38 may be composed of flexible wire, plastic, or other pliable, bendable material capable of bending upon insertion into a dense snow pack, and having sufficient retention strength to remain in a reconfigured position when acted upon by external extraction forces. Flange 32, connector 34, and insertion rod 36 may be three independent components of anchoring base 30, or integrally formed of one piece. The present invention does not limit the construction. Mechanical members 38 are attached to insertion rod 36. If bristles are used, individual groups of bristles are formed, extending radially outward, and circumferentially extending outward from insertion rod 36. Preferably, mechanical members 38 are angled slightly upwards towards connector 34. This positioning makes insertion easier, while adding additional strength to resist direct vertical extraction. Mechanical members 38 should be oversized relative to any pre-drilled hole into which each anchoring base 30 is inserted. This is assured by the user employing a drill-bit smaller in a radius than the radial extension of the mechanical members. Since mechanical members 38 may be flexible enough to bend upon insertion into the pre-drilled hole in the snow pack, they will tend to bend upward upon insertion. Once inserted, if upward forces are applied to anchoring base 30, as would be experienced in any attempt to pull the slalom pole out of the snow pack, the extended mechanical members 38 will engage the snow pack along the inside surface of the pre-drilled hole and sufficiently resist removal. In this manner, a large differential force is achieved between the insertion force, which is relatively small, and the vertical extraction force, which by design must be much greater.

Figure 4:
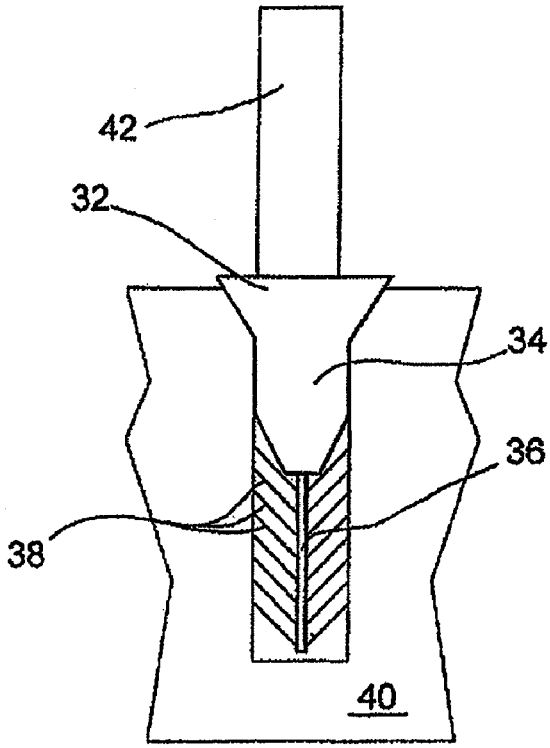
FIG. 4 depicts a slalom pole segment, including anchoring base and spring cartridge, inserted into a snow pack.

As depicted in FIG. 4, as an alternative embodiment, anchoring base 30 may include a flange 32. Flange 32 provides an alignment and depth guide to ensure proper placement of anchoring base 30 during insertion. By inserting anchoring base 30 at a proper, pre-determined depth to approximately the height of flange 32, anchoring base 30 is assured to be at an optimal depth for mechanical members 38 to grab or engage the snow pack 40 effectively and at an optimal depth for the spring mechanism to function effectively.

Other features of the preferred embodiment that contribute to proper function are identified in FIG. 4. For example, as flange 32 impacts snow pack 40, it centers the slalom gate in the hole and provides a vertical reference for the gate. In addition, flange 32 laterally compacts the snow at the top of the pre-drilled hole, and provides a more stable alignment surface for the base. Moreover, flange 32 provides a secure platform for anchoring base 30 to attach to spring cartridge 42 along with the remainder of the slalom gate components.

Connector 34 is hollow, thereby providing an internal cavity to receive all or a portion of spring cartridge 42. The outer diameter of connector 34 is preferably the size of the pre-drilled hole to form a tight, friction fit that helps stabilize the slalom gate in the lateral direction in snow pack 40. Connector 34 is shown having a hard, smooth outer surface; however, in alternative embodiments, connector 34 may comprise a compliant surface, formed from foam or rubber, and may include mechanical members extending radially outward, such as those extending from insertion rod 36. Mechanical members on connector 34 are preferably the same length or a shorter length than the mechanical members extending from insertion rod 36.

As previously discussed, the mechanical members may be bristles, or preferably tufts of bristles, inserted into holes within insertion rod 36 and mechanically secured according to the prevailing art associated with brush making, such as by staple, glue, or other acceptable means. The bristles may extend completely through insertion rod 36, forming at least two radial mechanical member extensions, or terminate within insertion rod 36, forming one radial mechanical member extension. When the bristles are angled during the fabrication process relative to insertion rod 36, the preferred angle is less than or equal to twenty-five (25) degrees upwards. A shaping sleeve may be used to set the bristles at the predetermined angle. The bristle tufts may be arranged in any number of rows, or other geometric pattern, such as a spiral configuration, or an equidistance spaced pattern, about insertion rod 36.

Figure 5C:
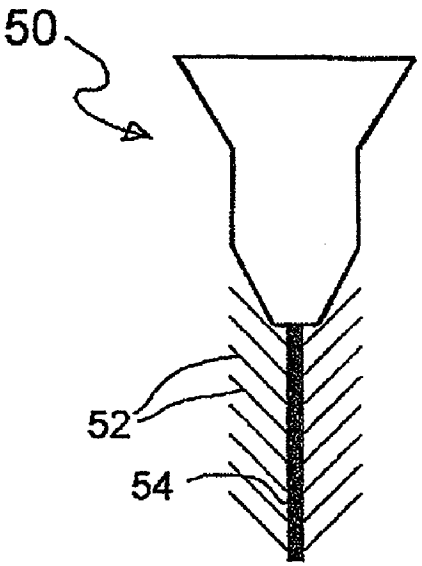
FIG. 5C depicts the resultant anchoring base of FIG. 5B having upwardly angling mechanical members, such as bristle tufts, after the shaping sleeve is removed.
Figure 5B:
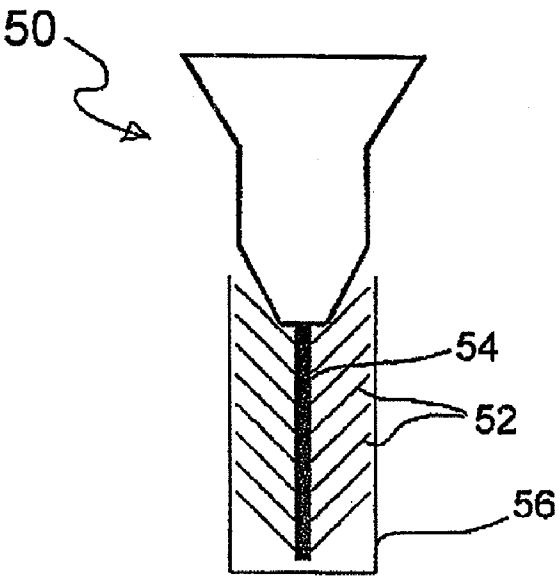
FIG. 5B depicts the bending of the mechanical members of the anchoring base of FIG. 5A when the anchoring base is inserted within a shaping sleeve.
Figure 5A:
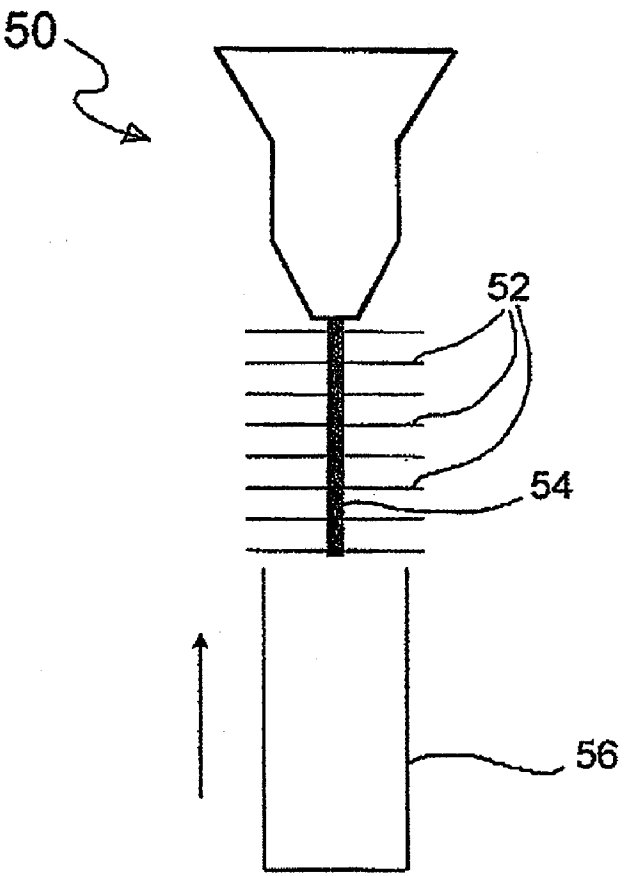
FIG. 5A depicts an anchoring base of the present invention having mechanical members extending normal to an insertion rod.

Alternatively, mechanical members 38 may be formed using a twisted wire brush fabrication technique. The twisted wires may comprise one or a plurality of wires. For the twisted wire approach, as part of the fabrication process, the bristles may be inserted into a hollow tube or shaping sleeve having a diameter smaller than the bristles in order to set a permanent angle to the bristles. FIG. 5A depicts an anchoring base 50 having bristle tufts 52 extending normal to insertion rod 54. Bristle tufts 52 are preferably made of a flexible wire material that is capable of retaining its reconfigured shape after force is applied. In this manner, when anchoring base 50 is inserted into a shaping sleeve or tube 56 having a diameter less than the total diameter extension of bristle tufts 52, bristle tufts 52 will bend upward towards the connector and/or flange direction. FIG. 5B depicts the bending of bristle tufts 52 when anchoring base 50 is inserted within shaping sleeve 56. FIG. 5C depicts the resultant anchoring base 50 with upwardly angling bristle tufts 52 after shaping sleeve 56 is removed.

Figure 6A:
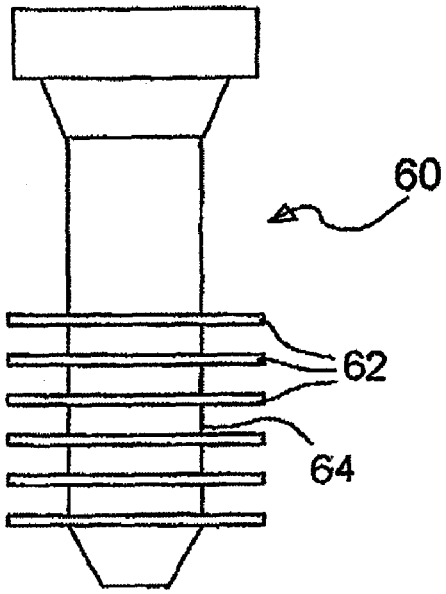
FIG. 6A depicts an alternative embodiment of an anchoring base having mechanical members comprising flexible discs or vanes.
Figure 6B:
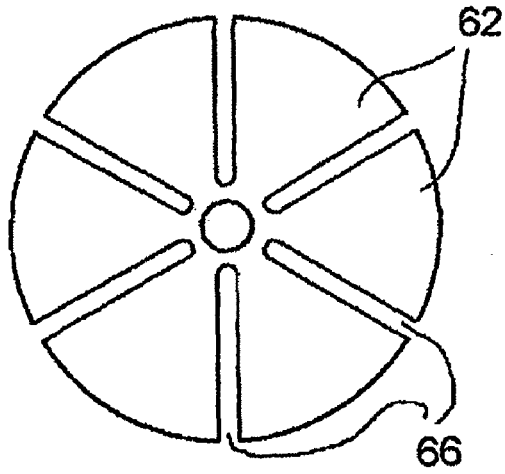
FIG. 6B is a top perspective view of the discs of FIG. 6A.

FIG. 6A depicts an alternative embodiment of an anchoring base 60 having mechanical members 62 comprising flexible discs or vanes. Flexible discs 62 may be round, as depicted in FIG. 6B in a top perspective view, but are not limited to any particular shape, and as such, square, pentagonal, hexagonal, or other n-sided figures may be employed, as well as non-straight edge shapes. As depicted in FIG. 6B, flexible discs 62 are shown with slots 66; however, they may be formed without perforations as well. Spacers 64 may be used to separate flexible discs 62. Spacers 64 may be separate from or integral with flexible discs 62.

Figure 7:
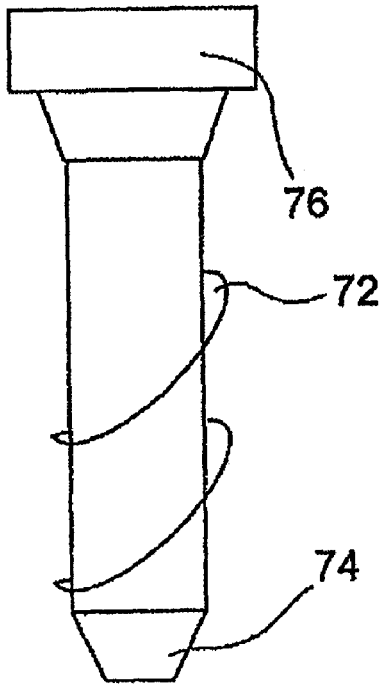
FIG. 7 depicts an alternative embodiment of an anchoring base of the present invention having a flexible, spirally wound vane as an extending mechanical member.

FIG. 7 depicts an alternative embodiment of an anchoring base 70 having an optional flange 76, and a flexible, spirally wound vane 72 terminating in an optional end cap 74.

In either alternative embodiment, flexible discs 62 or spirally wound vane 72 would reconfigure during insertion in a similar fashion as the bristle tufts, bending upwards relative to the insertion rod, and remaining in an upward slanted direction once inserted in the pre-drilled hole with enough strength to resist vertical extraction forces.

At some point, each slalom gate will need to be extracted from the snow pack. The present invention provides for easy extraction through the reconfiguration, for a second time, of the mechanical members of the anchoring base, such that the mechanical members no longer strenuously impede the upward extraction forces.

Figure 8B:
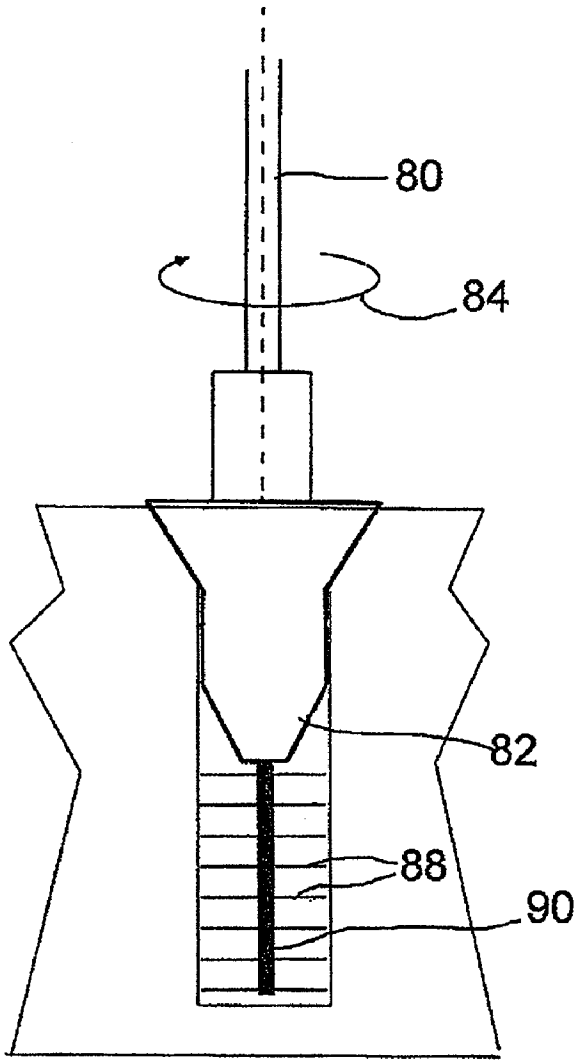
FIG. 8B depicts the change in position of the mechanical members of the slalom pole of FIG. 8A after the extracting rotation is performed.
Figure 8A:
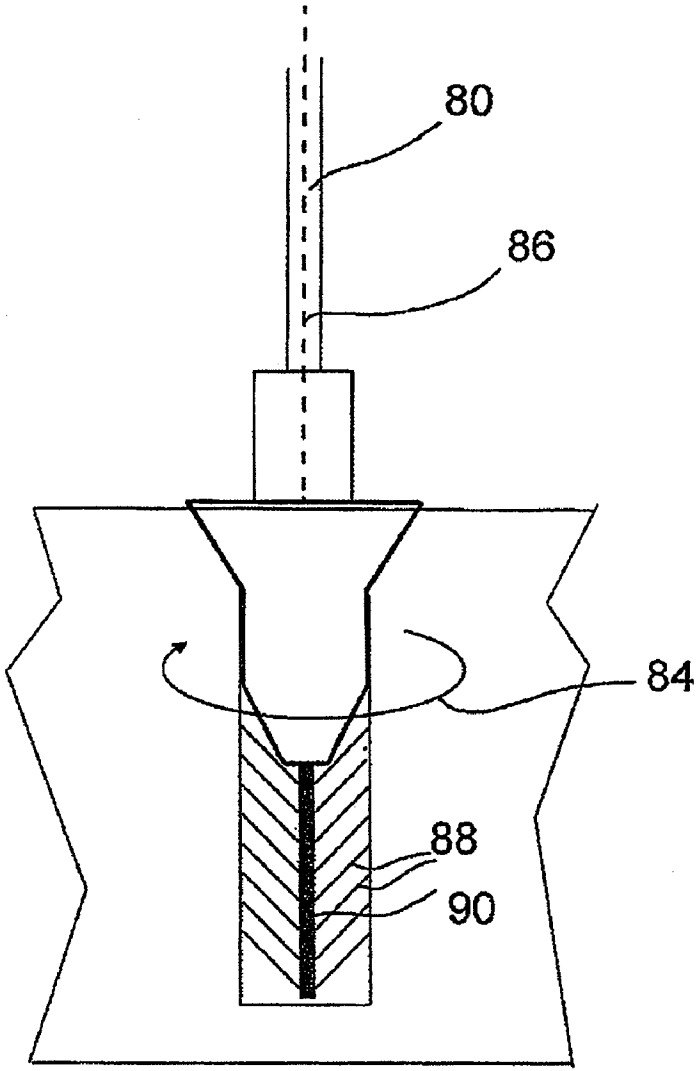
FIG. 8A depicts the slalom pole of the present invention being rotated about its longitudinal axis upon extraction.

As depicted in FIG. 8A, in order to extract slalom pole 80 having an anchoring base 82 of the present invention, a rotation 84 about the slalom pole's longitudinal axis 86 is required. This will reconfigure the upwardly angled mechanical members 88. FIG. 8B depicts mechanical members 88 after the extracting rotation is performed. Mechanical members 88 will lose the upwardly angled position and extend radially normal from and circumferentially from insertion rod 90. In the case where mechanical members 88 are more flexible, they may remain in an upwardly angled direction, but twist around and compact closer to insertion rod 90.

Figure 9A:
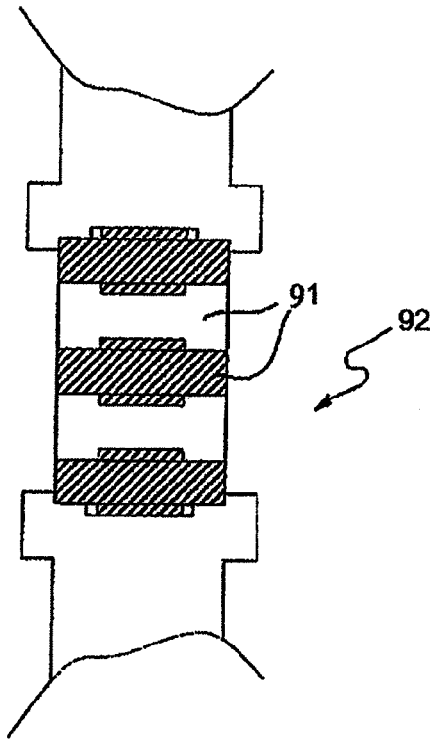
FIG. 9A depicts a stack of interlocking rings in the spring cartridge of the present invention.
Figure 9B:
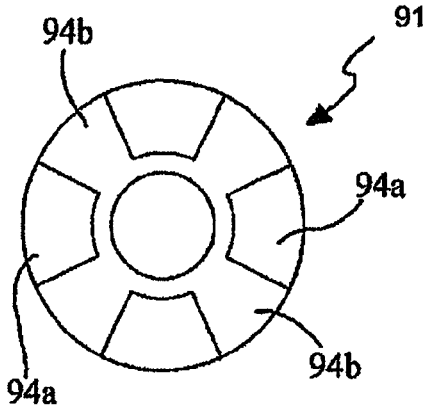
FIG. 9B depicts a top view of an interlocking ring having four teeth for interlocking.
Figure 9C:
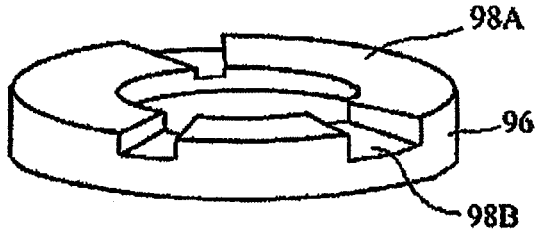
FIG. 9C is a top perspective view of an interlocking ring having three teeth.

One embodiment of the present invention provides for a mechanically strong spring cartridge in order to facilitate rotation during slalom pole extraction. In this embodiment, the rings in the spring cartridge are formed with gears, such as teeth and notches. These gears are naturally engaged by the compression forces of the spring. The engaged rings allow the transmission of the rotational torque from the shaft or pole element to the anchoring base. In this manner rotation of the slalom pole shaft or spring cartridge will in turn rotate and reconfigure the mechanical members extending from the anchoring base, allowing the anchoring base to be easily removed from the snow pack without over-twisting the spring cartridge. FIG. 9A depicts a stack of engaged interlocking rings 91 of the present invention in spring cartridge 92. Each ring 91 has interlocking teeth that form a mechanical structure rigid to rotation when properly engaged. FIG. 9B depicts a top view of a ring 91 with four teeth 94*a* and four reciprocal grooves or indentions 94*b*. Each ring is fabricated with a center aperture to allow clearance for the slalom pole tendon as needed. The rings may have any number of teeth and notches provided sufficient mechanical strength is achieved to withstand the rotational forces applied upon extraction. Six teeth and notch sets have been shown to be effective, but not uniquely effective. Additionally, the teeth and notches may be shaped in a tongue and groove fashion, V-shaped, U-shaped, or may be any other shaped protrusions and corresponding interlocking indentations capable of securing adjacent rings from twisting relative to one another. FIG. 9C is a top perspective view of a ring 96 having three teeth 98*a* and three adjacent notches or indentations 98*b*.

Figure 10A:
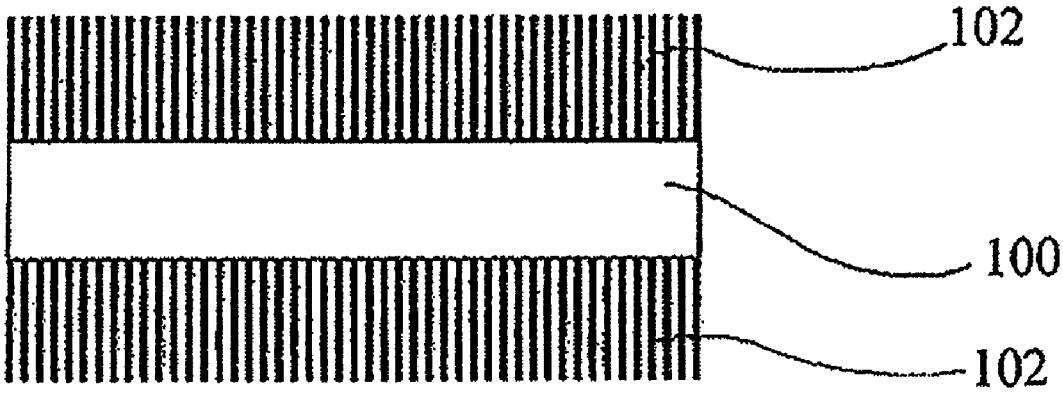
FIG. 10A depicts the alternative embodiment of rings having interlocking bristles.

As an extension to the aforementioned rings with interlocking teeth, in an alternative embodiment, the teeth and notches may be replaced with bristle elements oriented in a vertical, axial direction. The bristle elements would engage other bristle elements on other rings and provide a means for translating torque from the shaft or spring cartridge to the anchoring base. FIG. 10A depicts the alternative embodiment of rings 100 having interlocking bristles 102.

Figure 10B:
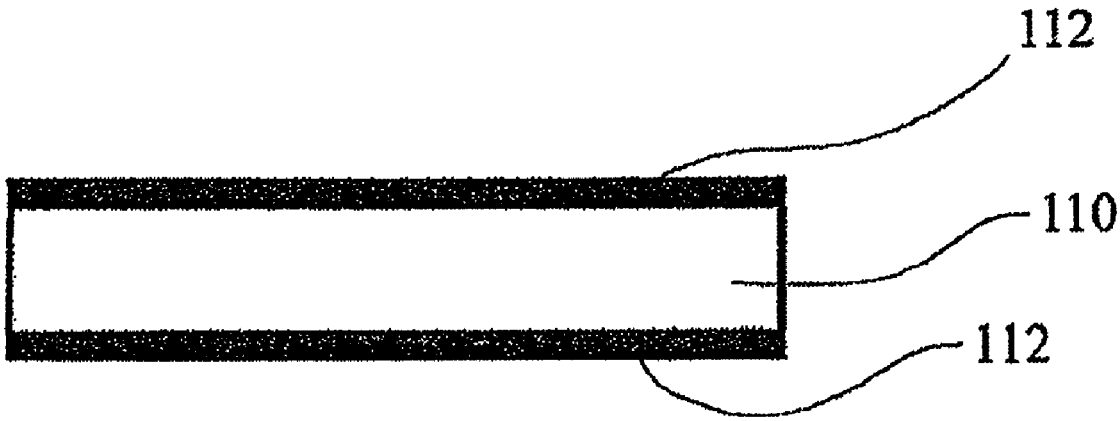
FIG. 10B depicts an interlocking disc structure having a material with a high coefficient of mechanical friction.

In yet another alternative embodiment, as depicted in FIG. 10B, the rings may be replaced with disc structure 110 including a material having a high coefficient of mechanical friction 112, such as a high-μ rubber. The high compression forces that are naturally part of the spring cartridge mechanism will generate sufficient torsional forces to transmit torque from the slalom pole shaft to the anchoring base, allowing for the second reconfiguration of the mechanical members.

Provisions may also be provided, such as wrench engaging means, on the top of the anchoring base flange or some other portion of the anchoring base to allow the user to rotate the base in the desired manner using current wrenches or wrenches specifically designed for this application.

Figure 11:
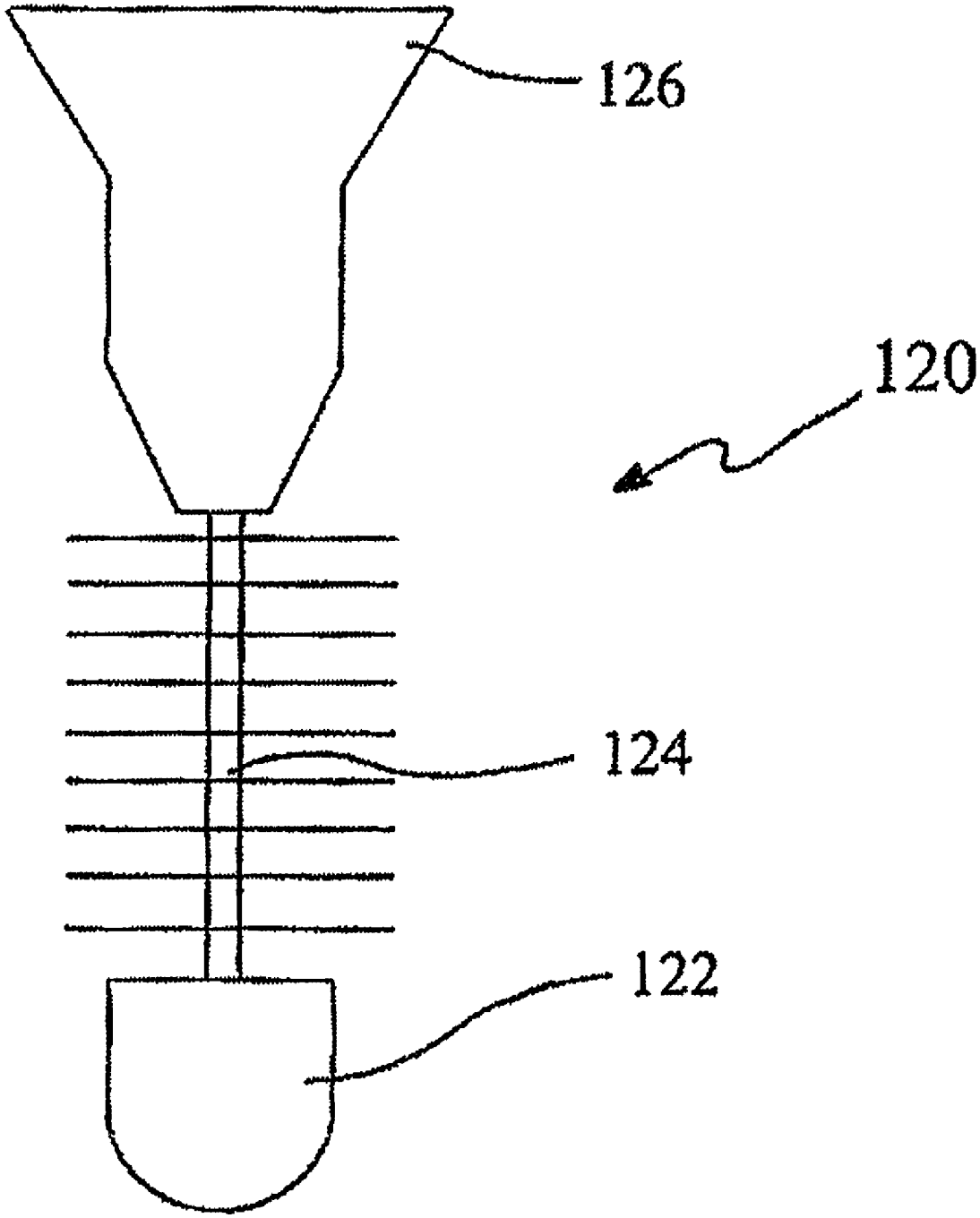
FIG. 11 depicts an anchoring base terminated with a bottom stabilizer.

FIG. 11 depicts an anchoring base 120 terminated with a bottom stabilizer 122. Stabilizer 122 is preferably fabricated from the same material as insertion rod 124, and may be integrally formed with insertion rod 124. Stabilizer 122 is used to restrict the lateral movement of the slalom pole's bottom end when impacted by external forces. Stabilizer 122 effectively pins the slalom pole's bottom end in the pre-drilled hole. Stabilizer 122 is preferably bulbous in shape, shown in cross-section in FIG. 11 as a rounded-end cylindrical bulb, having approximately the width of the pre-drilled hole. When stabilizer 122 is used in conjunction with flange 126, both the top and bottom portions of the anchoring base 120 will resist lateral motion.

Figure 12:
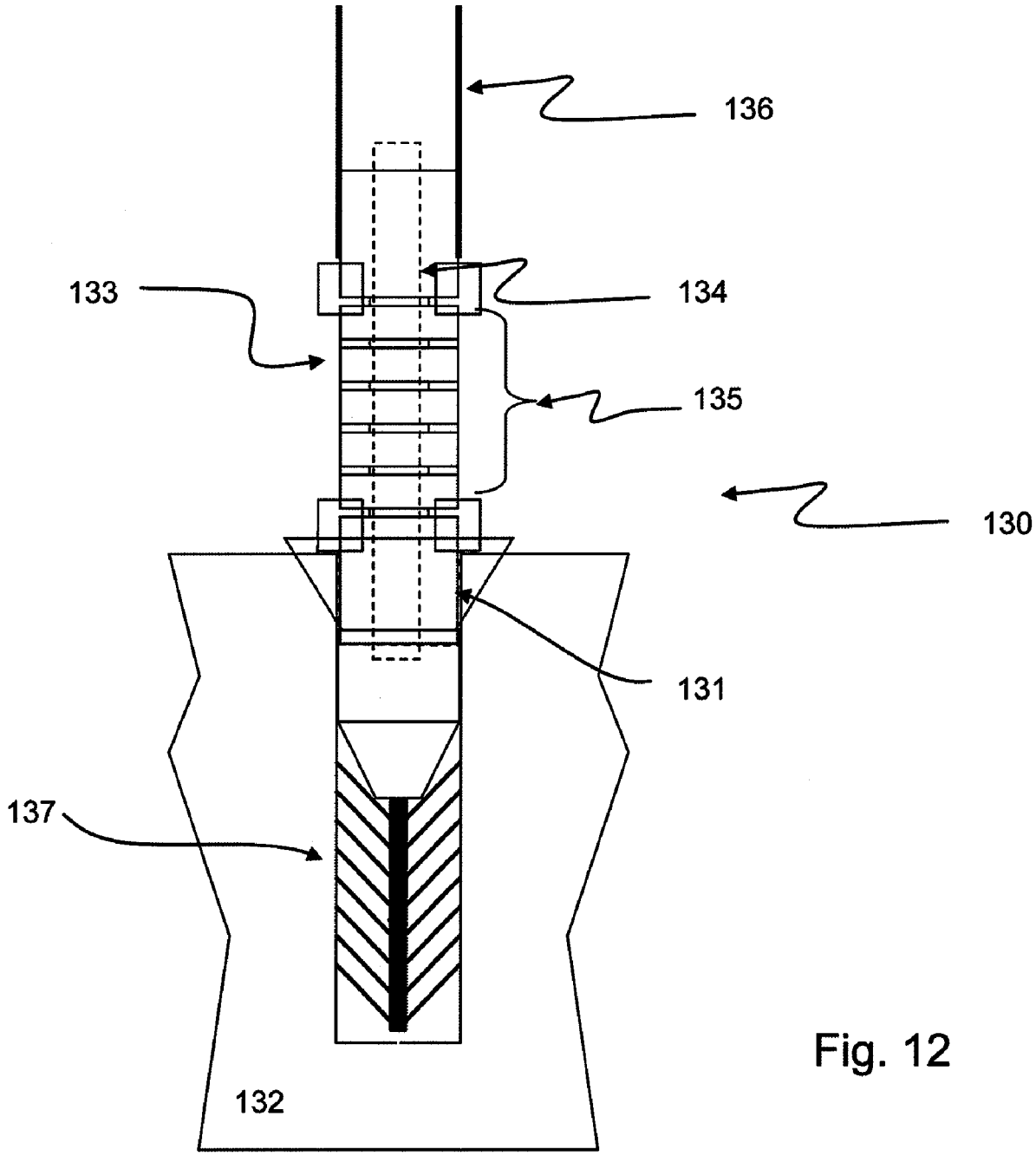
FIG. 12 depicts an anchoring base with a spring cartridge having a plurality of interlocking rings.

FIG. 12 depicts a slalom pole structure 130 with an anchoring base 131 inserted in a snow pack 132. Anchoring base 131 is attached to a spring cartridge 133, which includes a spring 134 and a plurality of interlocking rings 135. A delineator pole 136 is attached to spring cartridge. Bristles or bristle tufts 137 are resilient flexible members used to secure anchoring base 131 within snow pack 132.

The present invention simplifies the insertion and extraction of a slalom pole. One method for inserting a slalom pole of the present invention into a dense snow pack is to drill a hole in the snow pack, and insert the anchoring base of the slalom gate into the pre-drilled hole up to the flange. Unlike slalom poles of the prior art, rotation of a slalom pole of the present invention, although not precluded, is not required for insertion.

In order to extract a slalom pole of the present invention, one may simply rotate the anchoring base and pull upwards. If interlocking rings are employed in the spring cartridge, the user may be able to perform this function without having to bend down to grasp the anchoring base, or have to use a specialized wrench. That is, one may twist the shaft, which in turn would lock the rings of the spring cartridge and rotate the anchoring base. Or one may rotate the anchoring base itself by means of a wrench. Once the mechanical members are reconfigured, the slalom pole is easily vertically extracted.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An anchoring base for a delineator pole for snow based applications comprising an insertion rod having a longitudinal axis, said insertion rod including a plurality of resilient mechanical members extending outwards relative to said insertion rod longitudinal axis, said plurality of resilient mechanical members bending or configuring upon insertion of said anchoring base, into a first position or configuration that facilitates insertion while impeding and resisting axial extraction forces, and upon subsequent rotation of said anchoring base, said plurality of mechanical members bending or reconfiguring into a second position or configuration reducing said anchoring base extraction resistance force.

2. The anchoring base of claim 1 including:

a flange; and a connector portion having a first end attached to said insertion rod and a second end attached to said flange, said connector including a plurality of resilient mechanical members.

3. The anchoring base of claim 1 including having said plurality of resilient mechanical members comprise flexible metal, wire, plastic, fibers, or rubber segments.

4. The anchoring base of claim 1 wherein said insertion rod comprises a wire brush structure.

5. The anchoring base of claim 1 wherein said plurality of resilient mechanical members includes flexible discs.

6. The anchoring base of claim 5 including slots or perforations in said flexible discs.

7. The anchoring base of claim 1 wherein said flexible resilient mechanical members comprise substantially flat segments with straight edges extending radially outwards from said insertion rod.

8. The anchoring base of claim 1 including a stabilizer for limiting lateral movement of said anchoring base.

9. The anchoring base of claim 8 wherein said stabilizer comprises a widening portion at a bottom end to reduce lateral motion after insertion.

10. An anchoring base for a delineator pole for snow based applications comprising an insertion rod having a longitudinal axis, said insertion rod including a plurality of resilient mechanical members extending a length radially outwards relative to said insertion rod longitudinal axis, said resilient mechanical members including a substantially flat portion, having a width or thickness less than said length, and aligned longitudinally and circumferentially, substantially in rows about said anchoring base, said plurality of resilient mechanical members bending or configuring upon insertion of said anchoring base, into a first position or configuration that facilitates insertion while impeding and resisting axial extraction forces, and upon subsequent rotation of said anchoring base, said plurality of mechanical members bending or reconfiguring into a second position or configuration reducing said anchoring base extraction resistance force.

11. A delineator pole for snow-based applications comprising:

an anchoring base including an insertion rod having a longitudinal axis, said insertion rod including a plurality of resilient mechanical members extending outwards relative to said insertion rod longitudinal axis, said plurality of resilient mechanical members bending or configuring upon insertion of said anchoring base, into a first position or configuration that facilitates insertion while impeding and resisting axial extraction forces, and upon subsequent rotation of said anchoring base, said plurality of mechanical members bending or reconfiguring into a second position or configuration such that said anchoring base extraction resistance force is reduced; and a spring cartridge comprising:

a flexible tendon;

at least one spring; and a plurality of rings or collars having interlocking members, such that each ring interlocks with an adjacent ring to form a rigid mechanical structure during rotation.

12. A method of extracting a delineating pole comprising a shaft, a spring cartridge, and an anchoring base having a plurality of resilient mechanical members, said method comprising:

reconfiguring said plurality of resilient mechanical members within a snow pack by rotating said delineating pole at said shaft or said at spring cartridge when said spring cartridge includes interlocking members to form a rigid mechanical structure during rotation with said anchoring base; and applying a vertical extracting force to said delineating pole.

13. An anchoring base for a delineator pole for snow based applications comprising:

an insertion rod having a longitudinal axis, said insertion rod including a plurality of resilient mechanical members extending outwards relative to said insertion rod longitudinal axis, wherein said plurality of resilient mechanical members comprises a plurality of bristles or bristle tufts, said plurality of resilient mechanical members bending or configuring upon insertion of said anchoring base, into a first position or configuration that facilitates insertion while impeding and resisting axial extraction forces, and upon subsequent rotation of said anchoring base, said plurality of mechanical members bending or reconfiguring into a second position or configuration reducing said anchoring base extraction resistance force; and a spring cartridge comprising:

at least one spring; and a plurality of rings or collars having interlocking members.

* * * * *